US008552231B2

(12) United States Patent
Knottenbelt et al.

(10) Patent No.: US 8,552,231 B2
(45) Date of Patent: Oct. 8, 2013

(54) SYNTHETICALLY DERIVED ILLUMINATING AND HEATING PARAFFIN OIL

(75) Inventors: Cyril David Knottenbelt, Mossel Bay (ZA); Carl Dunlop, Cape Town (ZA); Kholekile Zono, Mossel Bay (ZA); Maxwell Thomas, Mossel Bay (ZA)

(73) Assignee: The Petroleum Oil and Gas Corporation of South Africa (Pty) Ltd., Mossel Bay (ZA)

( * ) Notice: Subject to any disclaimer, the term of this patent is extended or adjusted under 35 U.S.C. 154(b) by 375 days.

(21) Appl. No.: 12/770,676

(22) Filed: Apr. 29, 2010

(65) Prior Publication Data

US 2010/0210737 A1 Aug. 19, 2010

Related U.S. Application Data

(62) Division of application No. 11/722,178, filed as application No. PCT/ZA2005/000186 on Dec. 20, 2005, now abandoned.

(60) Provisional application No. 60/638,433, filed on Dec. 22, 2004.

(30) Foreign Application Priority Data

| | | |
|---|---|---|
| Dec. 23, 2004 | (ZA) | 2004/10360 |
| Feb. 16, 2005 | (ZA) | 2005/1372 |
| Feb. 16, 2005 | (ZA) | 2005/1373 |

(51) Int. Cl.
*C10L 1/04* (2006.01)
*C10L 1/10* (2006.01)

(52) U.S. Cl.
USPC ..... 585/14; 208/16; 208/17

(58) Field of Classification Search
USPC ..... 208/16, 17; 585/14
See application file for complete search history.

(56) References Cited

U.S. PATENT DOCUMENTS

| | | | | |
|---|---|---|---|---|
| 3,384,574 | A | 5/1968 | Halik et al. | |
| 3,522,169 | A | 7/1970 | Ireland | |
| 2004/0149627 | A1 * | 8/2004 | Koide et al. | 208/15 |

FOREIGN PATENT DOCUMENTS

| | | | | |
|---|---|---|---|---|
| DE | 25 28 236 | A1 | | 1/1977 |
| DE | 2528236 | A | * | 1/1977 |
| GB | 1 286 571 | A | | 8/1972 |
| WO | WO 2004/009744 | A | | 1/2004 |

* cited by examiner

*Primary Examiner* — Pamela H Weiss
(74) *Attorney, Agent, or Firm* — Knobbe, Martens, Olson & Bear, LLP

(57) ABSTRACT

The invention provides synthetically derived distillate kerosene produced by catalytic conversion of Fisher-Tropsch derived light olefins to distillates (COD) and hydrotreating thereof. The kerosene boils in the range of about 170 to 250° C. and includes less than 10% n-paraffins, more than 75% iso-paraffins and less than 1% aromatics.

9 Claims, No Drawings

SYNTHETICALLY DERIVED ILLUMINATING AND HEATING PARAFFIN OIL

CROSS-REFERENCE TO RELATED APPLICATIONS

This application is a divisional of U.S. application Ser. No. 11/722,178 filed Jan. 9, 2008, which is the national phase under 35 U.S.C. §371 of prior PCT International Application No. PCT/ZA2005/000186 which has an International filing date of Dec. 20, 2005, which designates the United States of America and which claims priority to U.S. Provisional Appl. No. 60/638,433 filed Dec. 23, 2004, South Africa Appl. No. 2004/10360 filed Dec. 23, 2004, South Africa Appl. No. 2005/1373 filed Feb. 16, 2005, and South Africa Appl. No. 2005/1372 filed Feb. 16, 2005, the disclosures of each of which are hereby incorporated by reference in their entireties.

FIELD OF THE INVENTION

This invention relates to synthetically derived Illuminating and heating paraffin oil, or kerosene, for household use and a process for its production.

BACKGROUND OF THE INVENTION

Household illuminating and heating kerosene has been known and used for since the late 1850's. Kerosene has a wide boiling range of 150-300° C. However, narrow boiling ranges are produced for improved control of final product combustion properties. Kerosene burning household appliances are manufactured with the specific characteristics of kerosene in mind. Known kerosene's are derived from crude oil by fractional distillation. Crude oil derived kerosene normally appears light yellow, contains sulphur, and aromatics which give the kerosene a distinct and negatively perceived odour.

Prior art processes for manufacturing illuminating and heating kerosene includes drying low sulphur paraffinic kerosene's to remove water and removing mercaptan by means of caustic washing or additional treatment to convert mercaptans to odorless disulphides. Highly paraffininic feed stocks may require additives to improve their performance in cold climates, these could include pour point depressants or wax crystal modifiers.

In the case of naphthenic or high sulphur crudes, processes for manufacturing illuminating and heating kerosene includes hydrotreating followed by acid treatment followed by water washing, or solvent extraction combined with caustic washing and clay treatment to remove undesirable aromatics and sulphur compounds. In the case of cracked feedstocks derived from heavy fuel oils, severe hydrotreating is required to remove olefins and other unstable compounds.

It is well known that aromatics are carcinogenic. When crude derived kerosene is burned it produces particulate matter, which leaves a residue. Residue needs to be cleaned from any household appliances. Crude derived kerosene also produces smoke and a distinct smell when it is burned. Due to the toxicity, appearance and odour of crude derived kerosene, it has not been widely accepted in modern households despite its relatively low cost. Recently however, synthetically derived kerosene appeared on the market. Synthetically derived kerosene is normally colourless and has preferred burning characteristics. Although it is more widely acceptable for household use than crude derived kerosene middle distillates, it contains aromatics. It is well known that aromatics are carcinogenic and gives the kerosene a distinct and still negatively perceived odour. An example of such known synthetically derived kerosene containing high levels of aromatics is a kerosene distillate cut from the High Temperature Fisher-Tropsch process. Household illuminating and heating kerosene contains three main types of paraffinic, naphthenic, and aromatic hydrocarbons. The quality of kerosene as a burning or heating oil is related to its burning characteristics and is dependent on such factors as its composition, volatility, viscosity, calorific value, sulphur content, and freedom from corrosive substances or contaminants.

It is an object of this invention to provide synthetically derived kerosene, which is colourless, odourless, non toxic, has excellent cold flow properties over a relatively wide boiling range while not giving away good flash point characteristics and having excellent burn characteristics.

The applicant is aware that, while paraffin's have excellent burning properties, aromatics, in particular multiple ring polynuclear aromatics, tend to burn less elegantly and contribute to smoke and carbon formation. Naphthenes have intermediate properties however, their combustion characteristics tend to be closer to paraffins than aromatic hydrocarbon types. In order to limit smoke formation, paraffinic feedstocks are selected for indoor illumination and heating purposes, and aromatic feedstocks especially those with multiple ring aromatics as well as cracked feedstocks containing olefins are avoided.

The applicant has found that the burn characteristics of kerosenes improve with in the presence of trace amounts of mono-aromatic species (single ring compounds only). The applicant has further found that too high levels of aromatics and naphtenes burn with a reddish and sometimes smoky flame. However, it is an object of this invention to provide a kerosene with negligible quantities of aromatics and comprising mainly of iso-paraffins.

In this specification, references to percentage proportions refer to mass percentage proportions. In this specification, general reference to burn characteristics, refers to burning characteristics in wick-fed yellow flame burners, which are not of the primus type however these fuels perform well in aspirated and high pressure atomising gun burners as well.

SUMMARY OF THE INVENTION

According to a first aspect of the invention there is provided a synthetically derived distillate kerosene produced by catalytic conversion of Fisher-Tropsch derived light olefins to distillates (COD) and hydrotreating thereof, the kerosene boiling in the range of about 170 to 250° C., and including:

less than 10% (mass) n-paraffins;
more than 75% (mass) iso-paraffins; and
less than 1% (mass) aromatics.

The kerosene may include about 10% naphtenes.

Alternatively, the kerosene may include:

less than 10% (mass) n-paraffins;
more than 60% (mass) iso-paraffins; and
less than 10% (mass) aromatics as mono aromatics only The kerosene may then also include about 10% (mass) naphthenes.

The applicant has found that naphthenes (cycloparaffins) also influence the burning characteristics of the kerosene. The applicant has found that about 10% (mass) of naphthenes in combination with the abovementioned ranges of n-paraffins, iso-paraffins and aromatics produces kerosene with good burning characteristics.

Preferably the boiling range may be between 180 to 215° C.

The flash point of the kerosene as measured by ASTM D93 may be higher than 60° C. for safety reasons but preferably lower than 80° C. for ease of ignition.

The kinematic viscosity at 40° C. of the kerosene as measured by ASTM D445 may be below about 1.5 cSt. The kinematic viscosity plays a role in capillary movement of the kerosene through the wick. It will be appreciated that kerosene with a low viscosity will move more readily through a wick than kerosene with a higher viscosity. It will be appreciated that poor viscosity can lead to inadequate vaporisation at the wick tip and lead to carbonisation and subsequent wick fowling.

The char value as measured by IP10 may be below 3 mg/Kg, preferably 2 or lower. Formation of char is normally formed by impurities including poly aromatic hydrocarbons and/or high boiling residues.

The total sulphur content of the kerosene may be below 0.3 ppm(m/m) as measured by ASTM 3120. Sulphur in kerosene can cause deposits of a lamp chimney, also known as "bloom". The presence of sulphur containing mercaptans leads to objectionable odours and leads to corrosion of household appliances.

The olefins content may be respectively reflected by a bromine number of less than 1 mg/100 g as measured by IP 129 and a peroxide number of less than 1 mg/100 g as measured by ASTM D3703. Catalytically cracked material that is high in olefin content tends to be less chemically stable and for sediment on prolonged storage. These olefins may also react with sunlight causing the product to oxidise and discolour.

The kerosene may further include perfumes and/or insect repellent. It will be appreciated that the kerosene function as a carrier for the perfume and/or insect repellent, which vaporise when the kerosene is burnt.

According to a second aspect of the invention, there is provided a process for the production of kerosene as described above, which process includes the steps of:

catalytic conversion of Fisher-Tropsch derived light olefins to distillates (COD) over a shape selective catalyst; and hydrotreating the COD product; and collecting a hydrotreated fraction boiling between about 170 to 250° C.

The Fisher-Tropsch derived olefins are converted to distillates over a shape selective zeolite catalyst. The conversion includes oligomerising and isomerising of the Fisher-Tropsch derived olefins to produce an intermediate olefinic COD product.

The hydrotreating step may include two steps, first distillate hydrotreating of the COD product followed by an optional second deep hydrotreating step to remove practically all aromatics. The hydrotreated fraction boiling between about 170 to 250° C. may be collected during the distillate hydrotreating step before the deep hydrotreating step.

Alternatively, the hydrotreating step may comprise a one step deep hydrotreating step of the COD product followed by collecting of the hydrotreated fraction boiling between about 170 to 240° C.

It will be appreciated that a one step reaction requires a lower capital and running costs, while the two step reaction enables better heat management.

The one step deep hydrotreating process may include hydrogenation over a Group 10 metal catalyst.

The Group 10 metal catalyst may include a high nickel content.

Alternatively, the Group 10 catalyst may include a noble metal such as supported platinum catalysts. These catalysts may also be bimetallic.

The catalyst may be Nickel supported on alumina or platinum supported on allumina. (Sud Chemie G134 or Axens LD 402).

The one step deep hydrotreating step may include hydrogenation over a high nickel content hydrotreating catalyst or hydrotreating with a noble metal catalyst. Reactor pressures for such reactions would typically range from 5000 kPa to about 8000 kPa but not excluding higher pressures. Reaction temperatures vary from about 200° C. to 260° C. while the LHSV range from 0.3 to 2 depending on the feed.

In the two step hydrotreating step, the intermediate olefinic product is hydrogenated over a nickel-molybdenum catalyst (Axens HR348 for such Sulphur and Nitrogen free feeds) or over cobalt-molybdenum catalysts. The support may be $Al_2O_3$ or $SiO_2/Al_2O_3$. The reaction temperature ranges from about 240 to below 350° C. at pressures of between 5000 to 8000 kPa. The hydrogen to hydrocarbon ratio is maintained at about 400 $nm^3$/hr at LHSV of between 0.3 and 1.

The kerosene has a low aromatic content comprising of only alkylated mono-aromatic species and contains no poly aromatic hydrocarbons. In order to remove these small quantities of mono-aromatics, the second, deep, hydrotreating step may follow.

The support for the metal may be neutral. The applicant is aware that an acidic support causes unwanted cracking during hydrogenation.

The olefin content measured as Bromine Number determines the reactivity of a particular feed, highly reactive feeds may require a portion of the hydrogenated product to be recycled to quench the hydrogenation reaction of the hydroteating step. The LHSV may also be altered to below 0.5 to control excessive exothermic reactions.

The hydrotreatment catalyst may be loaded into the reactor bed in an increased graded approach to limit an excessive exothermic reaction developing at the top of the reactor. The catalyst bed may have multiple zones with increased grades. Typically, a 4-zone graded catalyst bed. The concentration of the active catalyst in each of the 4 zones may be diluted with an inert ceramic in the following typical ratios of catalyst to ceramics, 0.2; 0.5; 170.0 and 650.

The catalytic conversion at pressures of more than 50 barg and/or a reactor temperature maintained below 280° C. produces a product stream with low aromatics and it will be appreciated that the relative low aromatics from the COD step allows moderate hydrogenation reactor conditions, limiting unwanted side reactions.

DETAILED DESCRIPTION OF THE PREFERRED EMBODIMENT

These synthetically derived middle distillates have been found to work particularly well as illuminating and heating oils in the household environment. This product provides excellent performance in wick fed appliances as well as in appliances where the fuel is atomised. Not only do these appliances give good performance but give excellent environmental and hygiene performance providing low smoke and chemical emissions free of any undesired chemical compounds. This product basis its excellent combustion characteristics, good environmental performance, the unique and environmentally responsible manner in which it is produced is highly recommend for indoor use. These fuels work particularly well in modern heaters that operate either with a wick or with heaters where the fuel is atomised prior to burning.

The invention is now described by means of non limiting examples:

EXAMPLE 1

A synthetically derived distillate (kerosene) produced by catalytic conversion of Fisher-Tropsch derived light olefins to distillates (COD) and hydrotreating thereof. The kerosene boils in the range of 185 to 220° C., and includes 7% (mass) n-paraffins, 87% (mass) iso-paraffins, 5.5% (mass) naphthenes and 0.05% (mass) aromatics.

The flash point of the kerosene as measured by ASTM 093 is at least 64° C.

The kinematic viscosity at 40° C. of the kerosene as measured by ASTM D445 is at least 1.3 cSt, however more typically 1.4 cSt.

The char value as measured by IP10is less than 2 mg/Kg, more typically 1 or lower. Formation of char is normally formed by impurities including poly aromatic hydrocarbons and/or high boiling residues.

The smoke point as measured by IP 57 has been found to be 45 mm. Smoke point reflects the maximum wick height that the wick of a yellow-flame type lamp can be turned up to prior to smoke formation, a high smoke point of as close to 45 mm is desirable.

The total sulphur content of the kerosene is below 0.3 ppm(m/m) as measured by ASTM 3120.

EXAMPLE 2

A synthetically derived distillate (kerosene) produced by catalytic conversion of Fisher-Tropsch derived light olefins to distillates (COD) and the hydrotreating thereof. The kerosene boils in the range of 180 to 220° C., and includes less than 7% (mass) n-paraffins; 75% (mass) iso-paraffins; 10% (mass) naphthenes and 8% (mass) aromatics as mono aromatics only.

The flash point of the kerosene as measured by ASTM D93 is at least 64° C.

The kinematic viscosity at 40° C. of the kerosene was measured by ASTM 0445.

The char value as measured by IP10 is 2 mg/Kg, more typically 1 or lower. Formation of char is normally formed by impurities including poly aromatic hydrocarbons and/or high boiling residues.

The smoke point as measured by IP 57 has been found to be 44 mm. Smoke point reflects the maximum wick height that the wick of a yellow-flame type lamp can be turned up to prior to smoke formation, a high smoke point of as close to 45 mm is desirable.

The total sulphur content of the kerosene is below 0.3 ppm(m/m) as measured by ASTM 3120.

EXAMPLE 3

Light olefins in the carbon range C3 to C6 originating from a High Temperature Fischer Tropsch plant located in Mossel Bay were oligomerised over a proprietary zeolyte catalyst (COD 9) as supplied by Sud Chemie. The oligomerisation reaction was performed at moderate temperatures below 280° C. and relatively high pressures of 55-bar process for the oligomerisation reaction to produce an oleffinic distillate with a Bromine Number of over 90 g Br/100 g sample. The olefinic portion of the sample was hydrotreated at moderate hydrotreating conditions in Diesel Hydrotreater unit equipped with a cobalt molybdenum (Engelhard E 5256) catalyst, at 58 kPa, the WABT did not exceed 321° C., the LHSV was maintained at 0.6 while the Hydrogen to Hydrocarbon Ratio was 275. A hydrotreated fraction boiling between about 170 to 250° C. is collected at a distillation column.

EXAMPLE 4

Light olefins in the carbon range $C_3$ to $C_6$ originating from a the High Temperature Fischer Tropsch plant located in Mossel Bay were oligomerised over a proprietary zeolyte catalyst (COD 9) as supplied by Sud Chemie. The oligomerisation reaction was performed at moderate temperatures below 280° C. and relatively high pressures of 55 bar process were used for the oligomerisation reaction to produce an oleffinic distillate with a Bromine Number of over 90 g Br/100 g sample. This distillate was hydrotreated in one step using a high Nickel content commercial catalyst as supplied by Sud Chemie. (Sud Chemie G134) The catalysts (about 270 cc) were loaded into a pilot plant reactor in a graded bed format and diluted with inert ceramics in the ratios of catalyst to ceramics of, 0.2; 0.5; 170.0 and 650. The reactor pressure was maintained at 58 bar, the WABT did not exceed 220° C., the LHSV was maintained at 0.9 and a third of the product was recycled back to the feed.

The one step hydrotreated distillate was fractioned by means of a true boiling point distillation apparatus to yield a kerosene fraction in the boiling range 170° C. to 250° C. This kerosene was found to contain less than 0.1% v/v aromatics and no detectable polyaromatic hydrocarbons.

EXAMPLE 5

Light olefins in the carbon range C3 to C6 originating from a the High Temperature Fischer Tropsch plant located in Mossel Bay were oligomerised over a proprietary zeolyte catalyst (COD 9) as supplied by Sud Chemie. The oligomerisation reaction took place at moderate temperatures below 280° C. and relatively high pressures of 55 bar process were used for the oligomerisation reaction to produce an olefinic distillate with a Bromine Number of over 120 g Br/100 g sample. This distillate was hydrotreated in one step using a supported Platinum commercial catalyst (Axens LD402). The catalyst (270 cc) was loaded into a pliot plant a graded bed format and diluted with inert ceramics. The reactor pressure was maintained at 60 bar, the WABT did not exceed 230° C., the LHSV was maintained at 0.9 and a portion of the product was recycled.

The one step hydrotreated distillate was fractioned by means of a true boiling point distillation apparatus to yield a kerosene fraction in the boiling range 170° C. to 250° C. This kerosene was found to contain less than 0.1% v/v aromatics.

The invention claimed is:

1. A synthetically derived distillate kerosene produced by catalytic conversion of Fisher-Trosch derived light olefins to distillates and hydrotreating thereof, the kerosene having a boiling range of from about 180 to 215° C., the kerosene comprising:

less than 7% (mass) n-paraffins;

75% (mass) iso-paraffins;

8% (mass) aromatics as mono aromatics only; and

10% (mass) naphthenes.

2. The synthetically derived distillate kerosene of claim 1, having a flash point as measured by ASTM D93 of from 60° C. to 80° C., a kinematic viscosity at 40° C. as measured by ASTM D445 below about 1.5 cSt, a char value as measured by IP10 below 2 mg/Kg, a total sulfur content of below 0.3 ppm(m/m) as measured by ASTM 3120, an olefins content reflected by a bromine number of less than 1 mg/100 g as measured by IP 129, and a peroxide number of less than 1 mg/100 g as measured by ASTM D3703.

3. The synthetically derived distillate kerosene of claim 2, which further comprising at least one additive selected from the group consisting of perfume and insect repellent.

4. The synthetically derived distillate kerosene of claim 1, having a smoke point as measured by IP 57 of 45 mm.

5. The synthetically derived distillate kerosene of claim 1, having a smoke point as measured by IP 57 of 44 mm.

6. A synthetically derived distillate kerosene produced by catalytic conversion of Fisher-Tropsch derived light olefins to distillates and hydrotreating thereof, the kerosene having a boiling range of from about 180 to 215° C., the kerosene comprising:

less than 10% (mass) n-paraffins;

more than 60% (mass) iso-paraffins; and from 8% (mass) to less than 10% (mass) aromatics as mono aromatics only.

7. The synthetically derived distillate kerosene of claim 6, having about 10% (mass) naphthenes.

8. The synthetically derived distillate kerosene of claim 6, having a flash point as measured by ASTM D93 of from 60° C. to 80° C., a kinematic viscosity at 40° C. as measured by ASTM D445 below about 1.5 cSt, a char value as measured by IP10 below 2 mg/Kg, a total sulfur content of below 0.3 ppm(m/m) as measured by ASTM 3120, an olefins content reflected by a bromine number of less than 1 mg/100 g as measured by IP 129, a peroxide number of less than 1 mg/100 g as measured by ASTM D3703, and a smoke point as measured by IP 57 of 44 mm or 45 mm.

9. The synthetically derived distillate kerosene of claim 6, which further comprising at least one additive selected from the group consisting of perfume and insect repellent.

* * * * *

UNITED STATES PATENT AND TRADEMARK OFFICE

CERTIFICATE OF CORRECTION

PATENT NO. : 8,552,231 B2
APPLICATION NO. : 12/770676
DATED : October 8, 2013
INVENTOR(S) : Knottenbelt et al.

It is certified that error appears in the above-identified patent and that said Letters Patent is hereby corrected as shown below:

In the Specification

In column 5 at line 17, Change “IP10is” to --IP10 is--.

In the Claims

In column 6 at line 53, In Claim 1, change “Fisher-Trosch” to --Fischer-Tropsch--.

Signed and Sealed this
Eighth Day of July, 2014

Michelle K. Lee

Michelle K. Lee
*Deputy Director of the United States Patent and Trademark Office*